US007040228B2

(12) United States Patent
Perault et al.

(10) Patent No.: US 7,040,228 B2
(45) Date of Patent: May 9, 2006

(54) SELF-CONTAINED VACUUM MODULE FOR STENCIL WIPER ASSEMBLY

(75) Inventors: Joseph A. Perault, Natick, MA (US); William Russell Claiborne, Worcester, MA (US)

(73) Assignee: Speedline Technologies, Inc., Franklin, MA (US)

( * ) Notice: Subject to any disclaimer, the term of this patent is extended or adjusted under 35 U.S.C. 154(b) by 0 days.

(21) Appl. No.: 10/784,121

(22) Filed: Feb. 20, 2004

(65) Prior Publication Data

US 2005/0183599 A1 Aug. 25, 2005

(51) Int. Cl.
*B41F 35/00* (2006.01)
*B41L 41/00* (2006.01)

(52) U.S. Cl. ..... 101/424; 101/423; 101/425; 15/21

(58) Field of Classification Search ..... 101/423, 101/424–425, 123, 129, 483; 134/15, 21, 134/9; 15/256.5, 330, 404
See application file for complete search history.

(56) References Cited

U.S. PATENT DOCUMENTS 3,620,230 A * 11/1971 Pierre ..... 134/9
4,307,662 A * 12/1981 Mitter ..... 101/123
5,491,871 A 2/1996 Reber et al.
5,918,544 A 7/1999 Doyle
5,976,269 A * 11/1999 Hamasaki et al. ..... 134/21
6,036,787 A 3/2000 Bennett et al.
6,626,106 B1 9/2003 Peckham et al.
2002/0148374 A1 10/2002 Peckham et al.
2003/0178048 A1 9/2003 Honkala et al.

FOREIGN PATENT DOCUMENTS

EP 0 956 952 B1 11/1999

OTHER PUBLICATIONS

U.S. Appl. No. 11/062,035, filed Feb. 23, 2005, LeClair, Thomas Paul.*
International Search Report for PCT/US2005/004658 mailed Jun. 20, 2005.

(Continued)

*Primary Examiner*—Andrew H. Hirshfeld
*Assistant Examiner*—Marissa Ferguson
(74) *Attorney, Agent, or Firm*—Lowrie, Lando & Anastasi, LLP

(57) ABSTRACT

A vacuum plenum module of a stencil wiper assembly for wiping and removing excess material from a stencil of a stencil printer includes a wiper blade to wipe the stencil, a plenum chamber in fluid communication with the wiper blade, and a vacuum generator attached to and in fluid communication with the plenum chamber to create a vacuum within the plenum chamber. The vacuum plenum module further includes a fluid supply to introduce pressurized fluid into the vacuum generator, and an exhaust to exhaust fluid from the vacuum generator. The vacuum generator includes at least one vacuum ejector adapted to create the vacuum. The vacuum plenum module is further configured to move between a first position in which the vacuum plenum is spaced away from the stencil and a second position in which the vacuum plenum engages the stencil. A method of cleaning a stencil is further disclosed.

14 Claims, 6 Drawing Sheets

OTHER PUBLICATIONS

Declaration for Patent Application (unexecuted) naming Joseph A. Perault, William Russell Claiborne, and Thomas Peter LeClair as inventors (Exhibit A).
Assignment document (unexecuted) (Exhibit B).
Letter from Marc S. Kaufman of Nixon Peabody LLP to Keith F. Noe of Lowrie, Lando & Anastasi, LLP, dated Aug. 9, 2004 (Exhibit C).
Letter from Keith F. Noe of Lowrie, Lando & Anastasi, LLP to Marc S. Kaufman of Nixon Peabody LLP dated Aug. 18, 2004 (Exhibit D).
Letter and attachments from Marc S. Kaufman of Nixon Peabody LLP to Keith F. Noe of Lowrie, Lando & Anastasi, LLP, dated Sep. 2, 2004 (Exhibit E).
Letter from Keith F. Noe of Lowrie, Lando & Anastasi, LLP to Marc S. Kaufman of Nixon Peabody LLP dated Sep. 20, 2004 (Exhibit F).
Declaration for Patent Application signed and dated by the inventors on Oct. 14, 2000 (Exhibit G).
Assignment signed and dated by inventors on Oct. 14, 2004 (Exhibit H).

* cited by examiner

SELF-CONTAINED VACUUM MODULE FOR STENCIL WIPER ASSEMBLY

RELATED APPLICATION

This application relates to U.S. patent application Ser. No. 10/784,122 entitled METHODS AND APPARATUS FOR CHANGING WEB MATERIAL IN A STENCIL PRINTER by Joseph Perault, Randy Peckham, Gary Freeman and Frank Marszalkowski, filed on even date herewith, and U.S. patent application Ser. No. 10/784,123 entitled METHODS AND APPARATUS FOR CLEANING A STENCIL by Joseph Perault and William Claiborne, filed on even date herewith. Both of these related applications are incorporated herein by reference.

BACKGROUND OF INVENTION

1. Field of Invention

The present invention relates generally to stencil cleaning methods and apparatus, and more particularly to a stencil printer including a stencil wiper assembly having a self-contained vacuum module.

2. Discussion of Related Art

In a typical surface-mount circuit board manufacturing operation, a stencil printer is used to print solder paste onto a circuit board having a pattern of pads or some other conductive surface onto which solder paste will be deposited. The circuit board is automatically fed into the stencil printer and one or more small holes or marks on the circuit board, called fiducials, is used to properly align the circuit board with the stencil or screen of the stencil printer prior to the printing of solder paste onto the circuit board. Once a circuit board has been properly aligned with the stencil in the printer, the circuit board is raised to the stencil, solder paste is dispensed onto the stencil, and a wiper blade or squeegee traverses the stencil to force the solder paste through apertures formed in the stencil and onto the board. As the wiper blade is moved across the stencil, the solder paste tends to roll in front of the blade, which desirably causes mixing and shearing of the solder paste so as to attain desired viscosity to facilitate filling of the apertures in the screen or stencil. The solder paste is typically dispensed onto the stencil from a standard cartridge.

In some prior art stencil printers, any excess solder paste remaining under the wiper blade after it has fully traversed the stencil remains on the stencil when the wiper blade is returned to its initial position for printing on a second circuit board. Usually, as the wiper blade passes the solder paste over the apertures, minute amounts of solder paste seep through the apertures to accumulate at the bottom side of the stencil. This presents various problems such as the solder paste being inadvertently disposed on the unintended areas of the circuit boards thereby jeopardizing the reliability of the printing process. Also, as the solder paste hardens, it complicates the alignment procedure of a circuit board with the stencil. Therefore, it is highly desirable to remove the excess solder paste that forms on the bottom of the stencil.

U.S. Pat. No. 5,918,544 to Doyle represents one prior art stencil printer having a well-known method and apparatus for cleaning the bottom of the stencil. Doyle discloses a wiping system that is positioned near the vicinity of the stencil and moves beneath the stencil from one end of the stencil to the other end. As the stencil wiper system moves beneath the stencil, it wipes off excess solder paste at the bottom of the stencil.

Specifically, the stencil wiper system includes a paper supply roller containing a roll of web material, such as paper, a take-up roller, at least one guide roller, a hollow solvent tube with numerous small openings formed along the length of the tube, and a vacuum plenum for removing excess moisture and hardened solder paste from the paper as it travels underneath the stencil. During a cleaning operation, a paper winder motor or drive rotates the paper supply roller by driving the take-up roller. The hollow solvent tube is filled with solvent by a solvent pump, which causes the solvent tube to squirt solvent through its numerous holes onto the paper as it passes the solvent tube. The solvent impregnated paper is passed to the vacuum plenum, which holds the paper in place as the stencil moves over the paper, thereby cleaning the stencil.

A disadvantage to the system described in Doyle, as well as other prior art wiper systems, is that a pump mechanism for creating the vacuum (negative pressure) at the vacuum plenum is typically located separate from the stencil wiper system itself. The pump is typically connected to the plenum using several (e.g., four or more) hoses so as to create vacuum at several places along the length of the plenum. Locating the vacuum generator remote from the wiper system has several disadvantages, such as the need to run many hoses through the machinery in order to connect the vacuum generator to the wiper system, which may be clumsy and may increase possibilities of failure of the system. In addition, each hose needs to be protected to avoid any bending or compression that could disrupt the airflow, thus the hoses are typically installed in metal casings in areas where crimping may occur to protect them. This results in a large amount of space being needed to run the several hoses to the vacuum plenum assembly and increased costs associated with the hoses and the protective casings.

SUMMARY OF INVENTION

A first aspect of the invention is directed to a vacuum plenum module of a stencil wiper assembly for wiping and removing excess material from a stencil of a stencil printer. The vacuum plenum module includes a wiper blade to wipe the stencil, a plenum chamber in fluid communication with the wiper blade, and a vacuum generator attached to and in fluid communication with the plenum chamber to create a vacuum within the plenum chamber. The vacuum plenum module further includes a fluid supply to introduce pressurized fluid into the vacuum generator, and an exhaust to exhaust fluid from the vacuum generator. The vacuum generator includes at least one vacuum ejector adapted to create the vacuum. The vacuum plenum module is further configured to move between a first position in which the vacuum plenum is spaced away from the stencil and a second position in which the vacuum plenum engages the stencil.

A second aspect of the invention is directed to a stencil printer including a stencil, a material applicator to apply material on the stencil, and a stencil wiper assembly to selectively wipe the stencil. The stencil wiper assembly includes a vacuum plenum module including a vacuum plenum assembly having a wiper blade and a plenum chamber, and a vacuum generator mounted on the plenum chamber of the vacuum plenum assembly and in fluid communication with the plenum chamber. The vacuum generator includes a chamber in fluid communication with the plenum chamber and at least one vacuum ejector disposed within the chamber. An air supply in fluid communication between the vacuum generator and an air supply delivers pressurized fluid to the vacuum generator. An exhaust in fluid communication between the vacuum generator and a collection chamber exhausts fluid from the vacuum generator. The plenum chamber is constructed to define an opening therein, wherein the vacuum generator is mounted to the plenum chamber such that the opening provides fluid communication between the plenum chamber and the chamber of the vacuum generator. A seal is disposed with the opening of the plenum chamber and the chamber of the vacuum generator to create a seal between the plenum chamber and the chamber of the vacuum generator. In one embodiment of the present invention the stencil wiper assembly further includes a supply roller to receive a roll of paper, a take-up roller to receive used paper, and a drive to move paper across the stencil between the supply roller and the take-up roller. The vacuum plenum module is operable to selectively engage the stencil with the paper disposed between the wiper blade and the stencil.

In a third aspect of the invention a method of cleaning a stencil of a stencil printer, having a stencil wiper assembly with a vacuum plenum, includes generating a vacuum directly at the vacuum plenum to create a vacuum within the vacuum plenum. The method further includes delivering a pressurized fluid to the vacuum plenum, and manipulating the pressurized fluid to create the vacuum.

BRIEF DESCRIPTION OF DRAWINGS

The accompanying drawings, are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
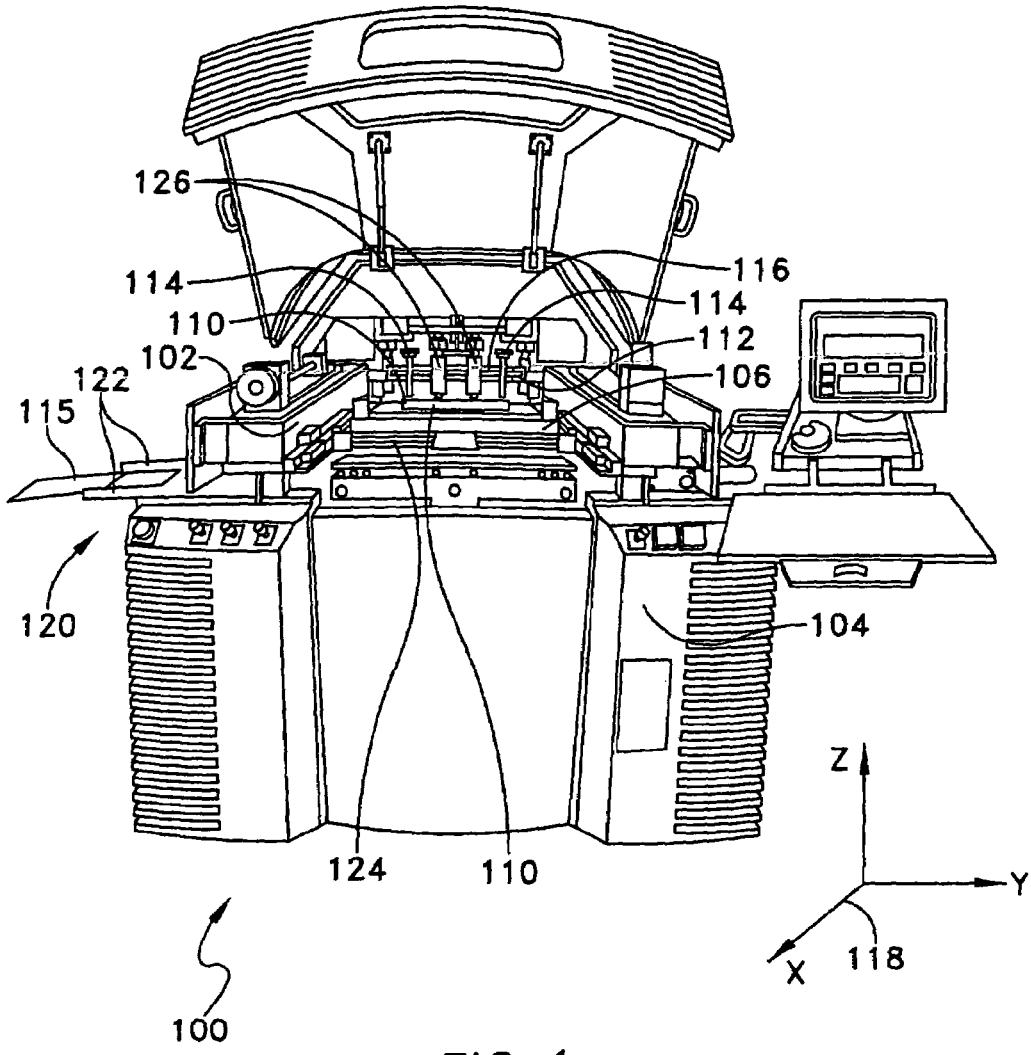
FIG. 1 is a front elevational view of a stencil printer in which embodiments of the present invention may be implemented.

For purposes of illustration, embodiments of the present invention will now be described with reference to a stencil printer used to print solder paste onto a circuit board. One skilled in the art will appreciate, however, that embodiments of the present invention are not limited to stencil printers that print solder paste onto circuit boards, but rather, may be used in other applications requiring dispensing of other viscous materials, such as glues and encapsulents. Further, stencil printers in accordance with embodiments of the present invention are not limited to those that print solder paste on circuit boards, but rather, include those used for printing other materials on a variety of substrates. Also, the terms screen and stencil may be used interchangeably herein to describe a device in a printer that defines a pattern to be printed onto a substrate. Thus, this invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

Figure 2:
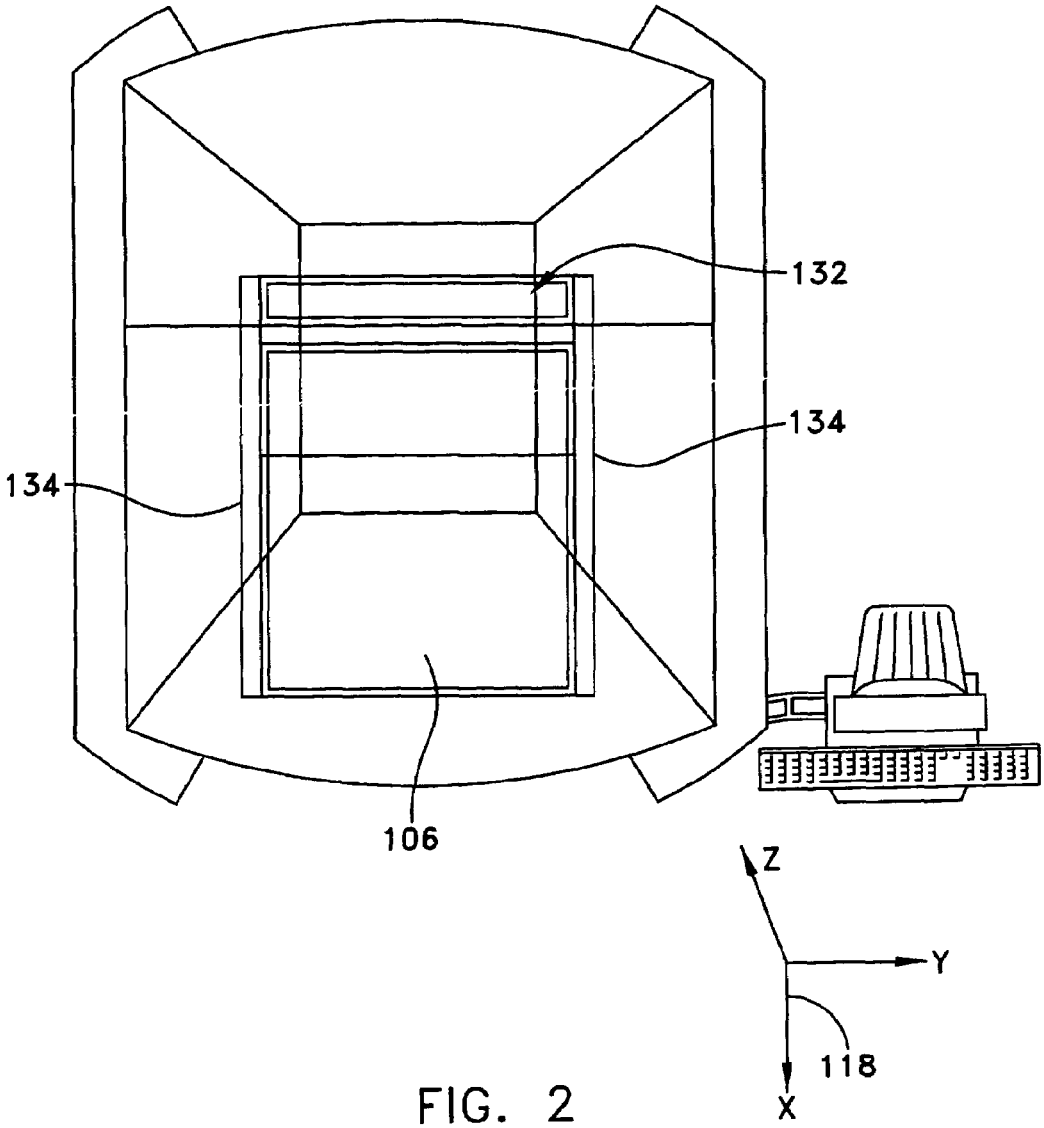
FIG. 2 is a diagrammatic top plan view of the stencil printer illustrated in FIG. 1 showing a stencil wiper apparatus in accordance with an embodiment of the present invention.

Referring to FIGS. 1 and 2, there is illustrated a stencil printer, generally indicated at 100, including a frame 102 that supports components of the stencil printer 100, including a controller 104, a stencil 106, and a dispensing head 108 having a dispensing slot 110 from which solder paste may be dispensed. The controller 104 is disposed within a cabinet of the stencil printer 100, and may be implemented, for example, using a personal computer having a Microsoft DOS or Windows NT operating system with application specific software to control the operation of the stencil printer 100. However, it is to be appreciated that although the controller 104 is illustrated as a personal computer, the invention is not so limited and the controller may be implemented in various structures and systems.

The dispensing head 108 is coupled to a first plate 112 using, for example, two thumbscrews 114. The first plate 112 is coupled to a second plate 116, which is coupled to the frame 102 of the stencil printer 100. The first plate 112 is coupled to the second plate 116 in such a manner that the first plate 112 can be moved with respect to the second plate 116 along a z axis, the z axis being defined by the coordinate axis system 118. The first plate 112 may be moved by motors under the control of the controller 104. The second plate 116 is movably coupled to the frame 102 such that the second plate 116 can move with respect to the frame 102 along an x axis, the x axis also being defined by the coordinate axis system 118. As described below in further detail, the movements of the first and second plates allow the dispensing head 108 to be placed over the stencil 106 and moved across the stencil 106 to allow printing of solder paste onto a circuit board 115.

The stencil printer 100 may also include a conveyor system, generally indicated at 120, having rails 122 for transporting a circuit board 115 to a printing position in the stencil printer 100. The stencil printer 100 may have a number of pins 124, positioned beneath the circuit board 115 when the circuit board is in the dispensing position. The pins 124 may be used to raise the circuit board 115 off of the rails 122 to place the circuit board 115 in contact with, or in close proximity to, the stencil 106 when printing is to occur.

According to one embodiment, the dispensing head 108 may be configured to receive two standard three-ounce or six one-ounce solder paste cartridges 126 that provide solder paste to the dispensing head 108 during a printing operation. Each of the solder paste cartridges 126 is coupled to one end of a pneumatic air hose housed within the stencil printer 100. As readily understood by those skilled in the art, the dispensing head 108 could be adapted to receive other standard, or non-standard, cartridges. The other end of each of the pneumatic air hoses is attached to a compressor that, under the control of the controller 104, provides pressurized air to the cartridges 126 to force solder paste to flow from the cartridges into the dispense head 108 and onto the stencil 106. Mechanical devices, such as pistons, may be used in addition to, or in place of, air pressure to force the solder paste from the cartridges 126 into the dispensing head 108.

According to one embodiment, the stencil printer 100 operates as follows. A circuit board 115 is loaded into the stencil printer 100 using the conveyor rails 122. The dispensing head 108 is then lowered in the z direction until it is in contact with the stencil 106. Pressurized air is provided to the cartridges 126 while the dispensing head 108 is moved in the x direction across the stencil 106. The pressurized air forces solder paste out the cartridges 126 and creates pressure on the solder paste in the dispensing head 108 thereby forcing solder paste from the dispensing slot 110 of the dispensing head 108 through apertures in the stencil 106 and onto the circuit board 115. Once the dispensing head 108 has fully traversed the stencil 106, the circuit board 115 is lowered back onto the conveyor rails 122 and transported from the printer so that a second circuit board may be loaded into the printer.

After one or more applications of the solder paste to the circuit boards, excess solder paste may accumulate at the bottom of the stencil 106. In order to remove excess solder paste, a stencil wiper assembly may be included that moves beneath the stencil 106. Referring to FIG. 2, a top view of the stencil printer 100 shown in FIG. 1, a stencil wiper assembly, generally indicated at 132, is provided in accordance with the invention. The stencil wiper assembly 132 is mounted on a pair of rails 134 and situated at one end of the stencil 106. According to one embodiment of the invention, the stencil wiper assembly 132 rides on linear rails 134 and is moved back and forth using a rack and pinion mechanism. Alternatively, a motor and belt mechanism may be used to reciprocate the stencil wiper assembly 132, as well as chain and pulley linear motor, or by an alternative mechanism. The stencil wiper assembly 132 may also stay stationary as the stencil 106 is moved over the stencil wiper assembly to perform the cleaning operation.

Figure 3:
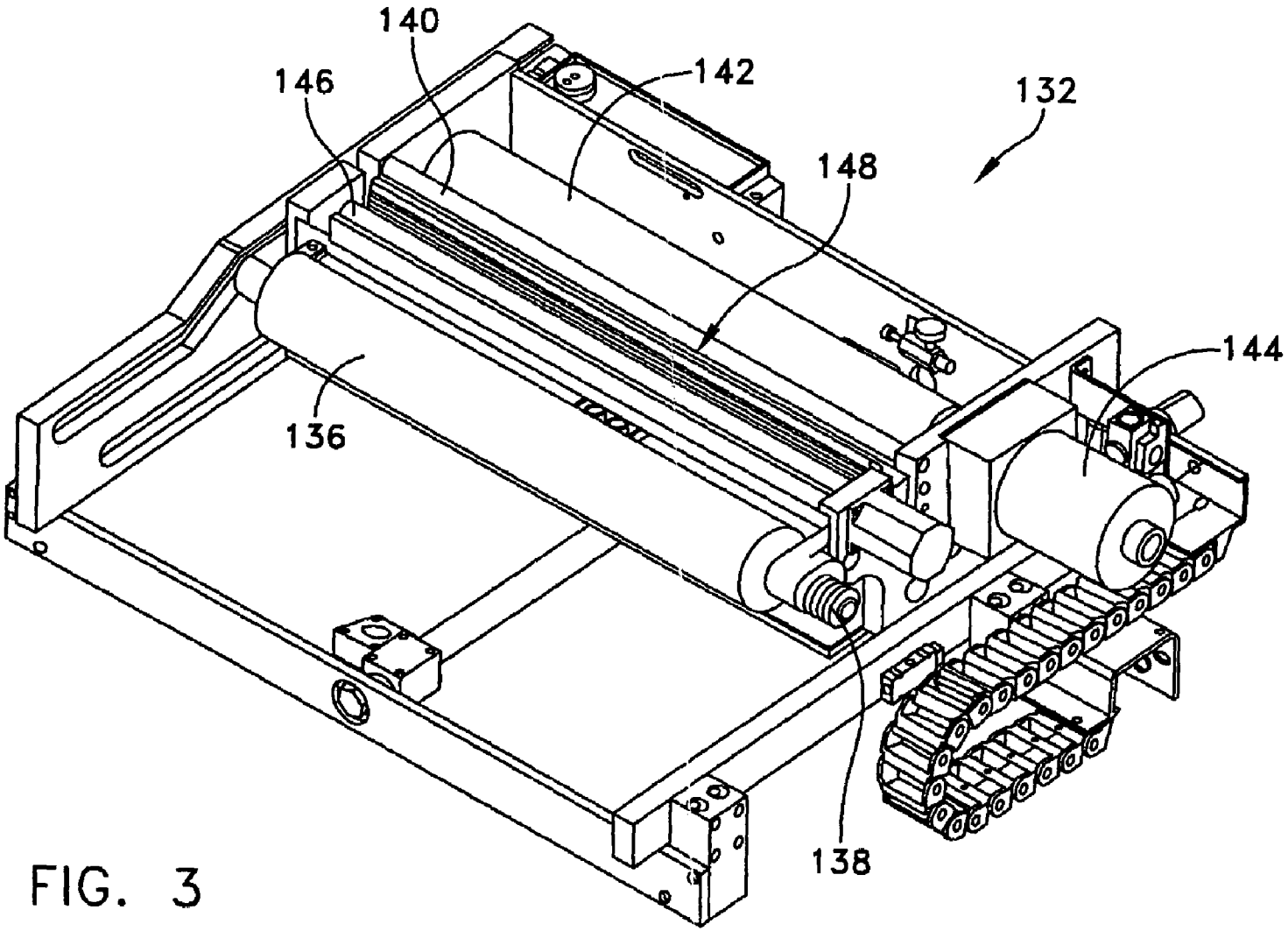
FIG. 3 is a perspective view of a stencil wiper apparatus.

Referring to FIG. 3, there is illustrated one example of a stencil wiper assembly 132 including a roll of paper 136 housed on a supply roller 138, at least one paper guide roller 140, a take-up roller 142 for receiving the used paper, and a paper or web material driver 144 for moving the paper across the stencil 106 in a linear direction from the supply roller 138 to the take-up roller 142. It should be noted that in FIG. 3 the web of paper is not shown as it extends over the various components of the stencil wiper assembly 132 so as to more clearly illustrate these components.

The stencil wiper assembly 132 further includes a hollow solvent tube 146 with numerous small openings formed along the length of the tube, and a vacuum plenum having a wiper blade, collectively referred to as vacuum plenum module, generally indicated at 148, for removing excess solvent and hardened solder paste from the paper as it travels underneath the stencil 106. The vacuum plenum module 148 is capable of moving the paper between a first position in which the paper is spaced away from the stencil 106 and a second position in which the paper engages the stencil 106. During a cleaning operation, the paper driver 144 rotates the paper supply roller 138 via the take-up roller 142, which passes paper over the hollow solvent tube 146. The solvent tube 146 is filled with solvent by a solvent pump and causes the solvent tube 146 to squirt solvent through its numerous holes onto the paper as it passes the solvent tube 146. The solvent impregnated paper is passed to the vacuum plenum module 148, which holds the paper in place as the stencil 106 moves over the paper, thereby cleaning the stencil 106. The vacuum plenum module 148 is operable to selectively engage the stencil 106 with the paper being disposed between the vacuum plenum module 148 and the stencil 106. In one embodiment of the invention, the operation of the supply roller 138, take-up roller 142 and driver 144 is described in detail in the related application entitled METHODS AND APPARATUS FOR CHANGING WEB MATERIAL IN A STENCIL PRINTER. Similarly, the operation of the solvent tube 146 is described in detail in the related application entitled METHODS AND APPARATUS FOR CLEANING A STENCIL.

Figure 4:
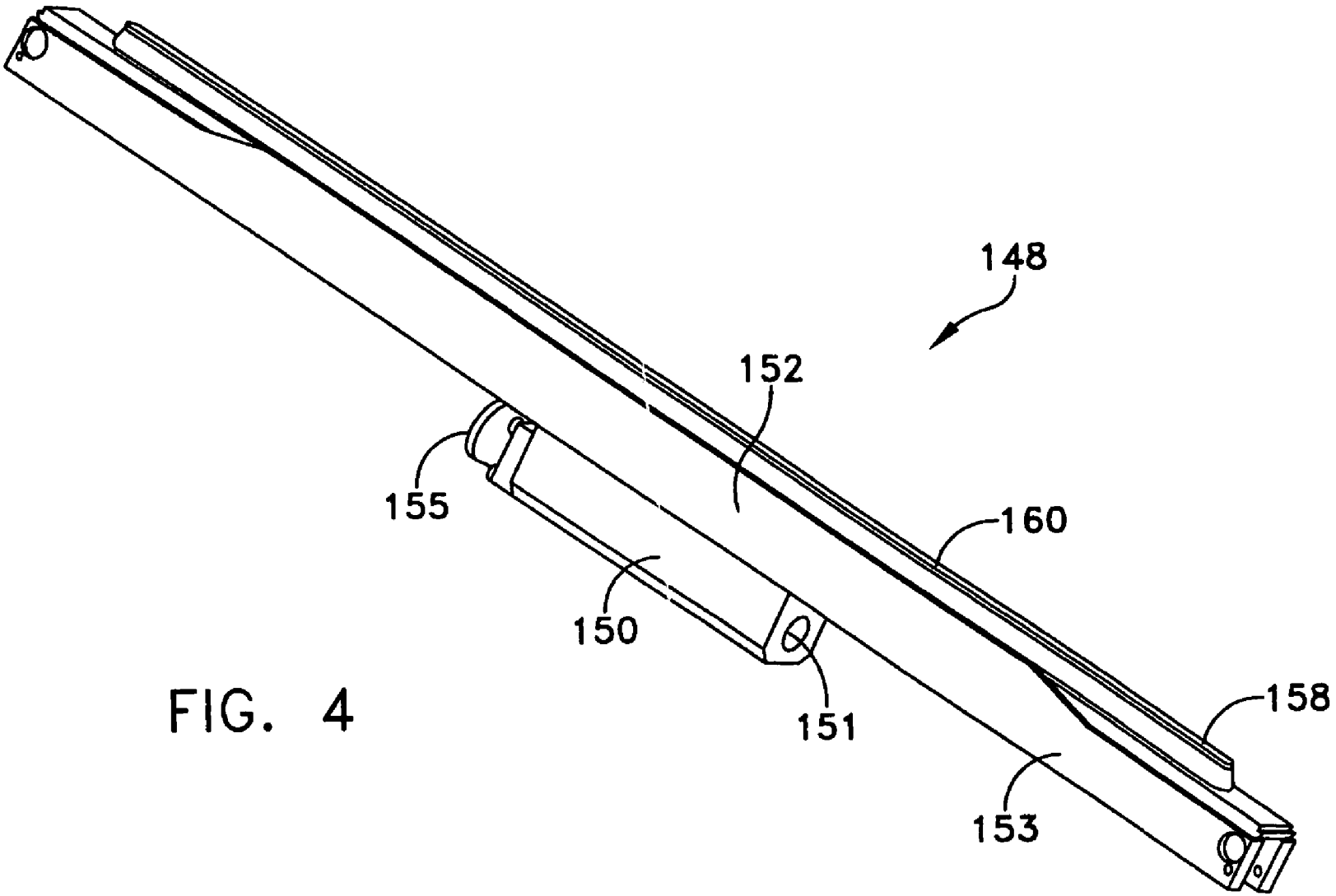
FIG. 4 is a perspective view of a vacuum plenum module of the stencil wiper apparatus.

According to one embodiment, illustrated in FIG. 4, the vacuum plenum module 148 includes a self-contained vacuum generator 150 of the present invention that is coupled to a vacuum plenum blade assembly 152. The vacuum plenum blade assembly 152 is constructed similarly to prior art vacuum plenums to remove excess solvent and hardened solder paste from the paper as it travels underneath the stencil 106. Unlike prior art designs, however, the vacuum generator 150 of the present invention is positioned proximate to the vacuum plenum blade assembly 152 rather than at a remote location within the cabinet of the stencil printer 100. Fixedly mounting the vacuum generator 150 on the vacuum plenum blade assembly 152 imparts several advantages, such as eliminating the need for a plurality of hoses positioned through and among the stencil printer machinery to connect a remote vacuum generator 150 to the vacuum plenum blade assembly 152. According to one embodiment of the present invention, the vacuum generator 150 may be of the type sold by Edco USA under model number Z-015-4.

Figure 5:
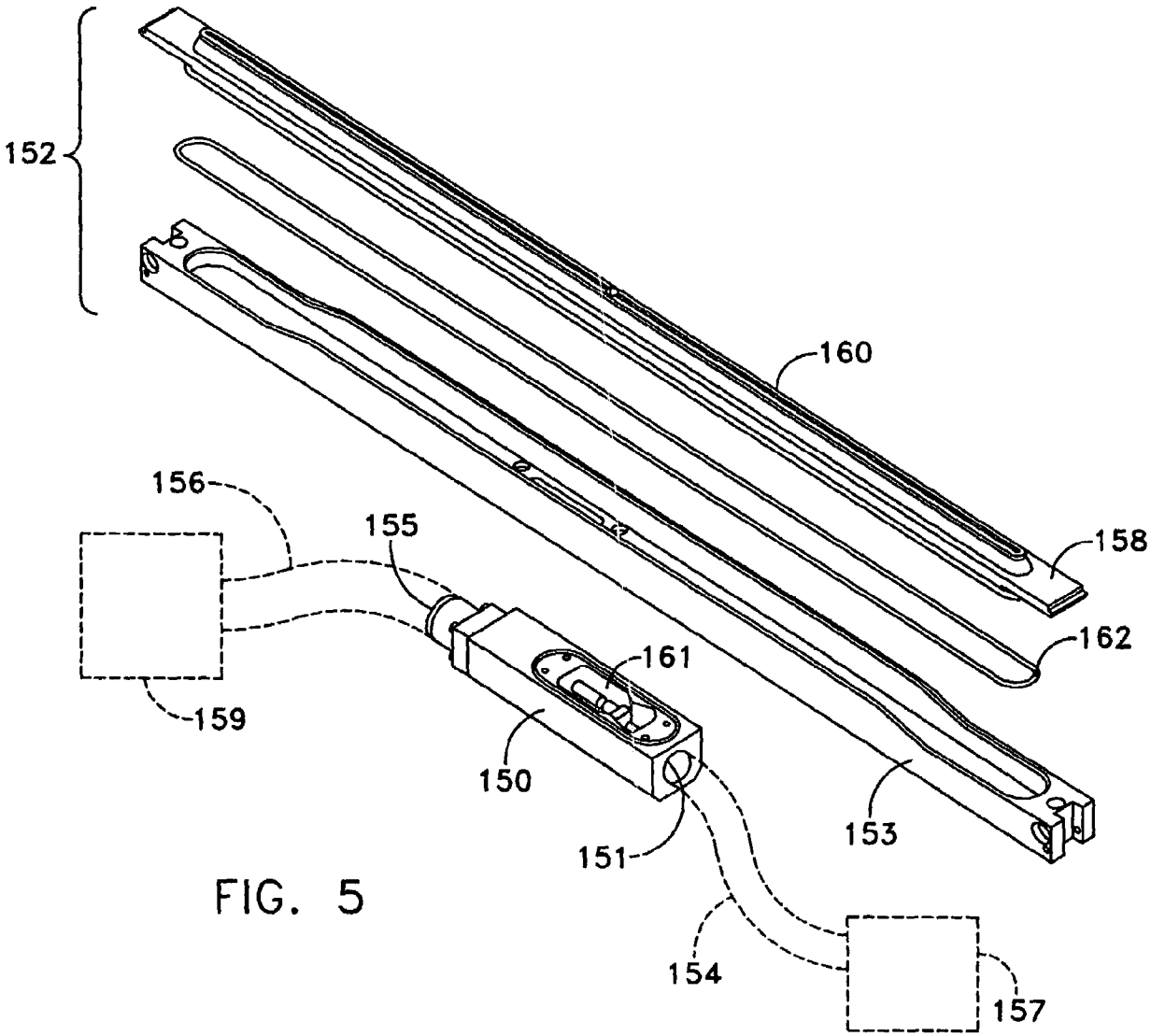
FIG. 5 is an exploded view of the vacuum plenum module illustrated in FIG. 4.

Referring to FIGS. 4 and 5, there is illustrated an exploded view of one embodiment of the vacuum plenum module 148 including the vacuum generator 150 according to the present invention. The vacuum plenum blade assembly 152 includes a plenum chamber 153 fixedly mounted on the vacuum generator 150 by suitable fasteners, such as machine bolts. The vacuum generator 150 has an inlet 151 that is adapted to be coupled to an air supply 157 via hose 154, and an outlet 155 that is adapted to be coupled to an exhaust hose 156 to exhaust air, excess solvent and removed solder material away from the plenum chamber 153 to a collection chamber 159. Operation of the vacuum generator 150 will be described in more detail below.

The vacuum plenum module 148 further includes a wiper blade 158 including a blade portion 160 used to move the paper against the stencil 106, as described above. The wiper blade 158 is fixedly connected to the plenum chamber 153 using, for example, an O-ring seal 162. The O-ring seal 162, or any other sealing mechanism, creates an airtight and/or fluid-impermeable seal between the wiper blade 158 and plenum chamber 153 such that the vacuum (i.e., negative pressure) created in the plenum chamber 153 draws excess material and solvent scraped by the wiper blade 158 into the plenum chamber 152. This scraped material may then be exhausted from the plenum chamber 153 via the vacuum generator 150 to the collection chamber 159.

As discussed above, the vacuum generator 150 is adapted to create a vacuum within the plenum chamber 153 to remove excess material scraped from the stencil 106 by the wiper blade 160. According to one embodiment, the vacuum generator 150 creates the vacuum or negative pressure in the plenum chamber 153 by creating a pressure differential between incoming airflow and exiting airflow within the vacuum generator 150. This pressure differential draws air and other material from the plenum chamber 153 into a chamber 161 formed in the vacuum generator 150 and out through the exhaust hose 156 via outlet 155. In one example, the air supply hose 154 may have a smaller diameter than the exhaust hose 156, as illustrated. This difference in size between the hoses may facilitate creating the pressure differential between the incoming and exiting airflows, thereby facilitating the creation of the negative pressure. However, the present invention should not be so limited, and the hose 154 may be the same size or larger than the exhaust hose 156 so long as the negative pressure is generated.

Figure 6:
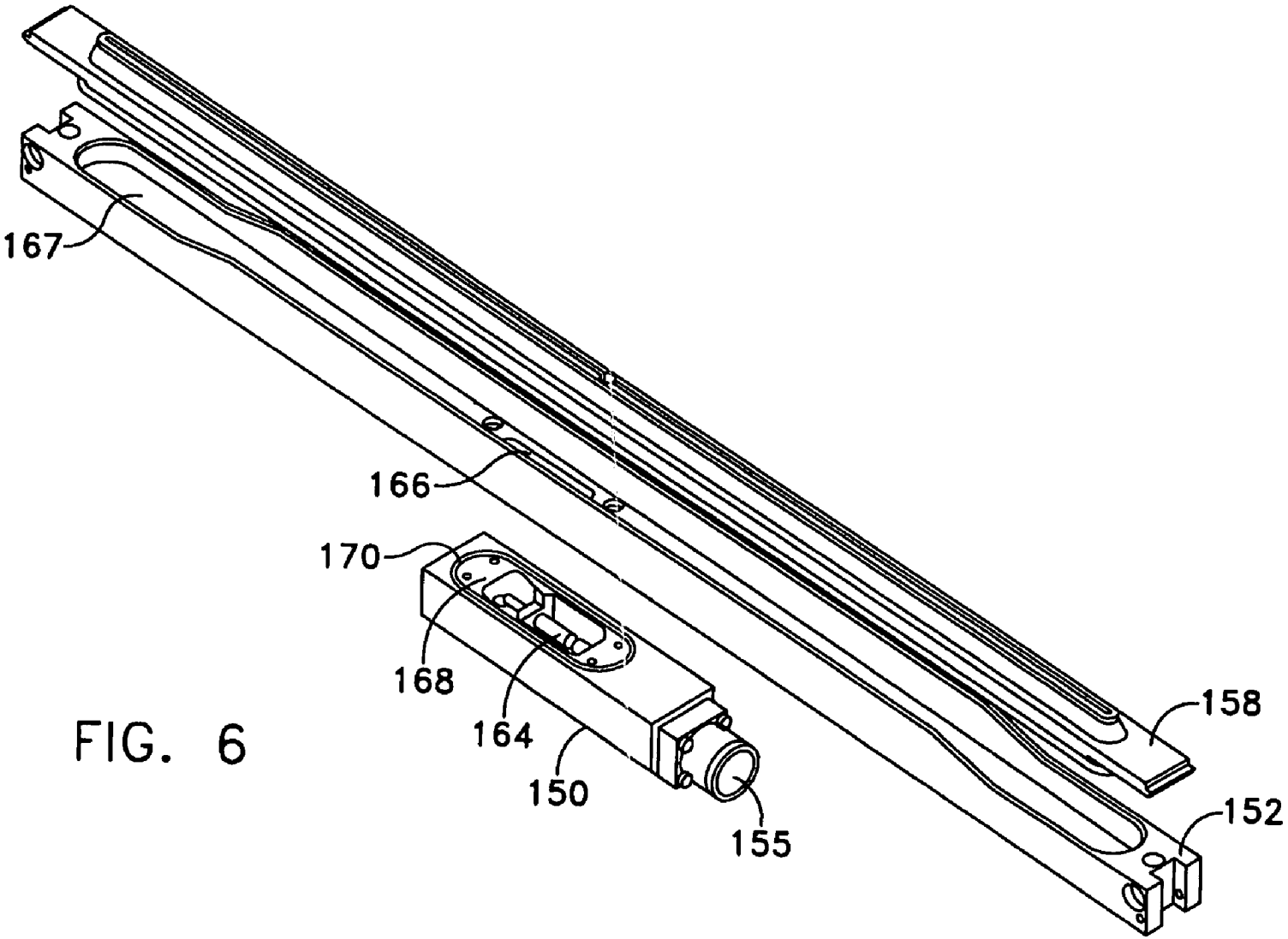
FIG. 6 is another exploded view of the vacuum plenum module illustrating internal components of a vacuum generator of the vacuum plenum module.

Turning now to FIG. 6, the vacuum generator 150 may comprise one or more ejectors, indicated at 164, such as, for example, venturi vacuum ejectors, to create the vacuum. The number of vacuum ejectors 164 may depend on a desired rate of airflow through the chamber 161 of the vacuum generator which, in turn, may depend on a desired vacuum force to be generated in the plenum chamber 153. Pneumatic and/or electrical controls are provided to increase or decrease the pressure differential within the chamber 161 by controlling via controller 104 the supply of pressurized air delivered to the vacuum generator 150 by source 157. As shown in FIG. 6, the plenum chamber 153 includes an opening 166 formed in a bottom wall 167 of the plenum chamber 152, to allow fluid communication between the plenum chamber 153 and the chamber 161 of the vacuum generator 150. The vacuum generator 150 includes a corresponding opening 168 and is sized to fit the opening 166 when mounting the vacuum generator 150 on the plenum chamber 153. The vacuum generator 150 may include a sealing element, for example, O-ring seal 170, to create a seal between the chamber 161 of the vacuum generator 150 and the plenum chamber 153.

Attaching the vacuum generator 150 directly to the vacuum plenum blade assembly 152 may have several significant advantages over the prior art systems with remotely located vacuum generators. For example, co-locating the vacuum generator 150 with the vacuum plenum blade assembly 152 removes the need to run a plurality of hoses through the stencil printer 100 and also the need for casings to protect such hoses. This can result in considerable space and cost savings. In addition, the co-located vacuum generator 150 may be smaller and more compact than a remotely located generator because the vacuum is being created at the plenum chamber 153. More specifically, with prior art vacuum plenums, a greater vacuum force must be generated because the vacuum generator is located a relatively long distance from the vacuum plenum, thereby requiring a larger vacuum generator.

Having thus described several aspects of at least one embodiment of this invention, it is to be appreciated various alterations, modifications, and improvements will readily occur to those skilled in the art. For example, although the vacuum generator 150 is illustrated as having an air supply hose 154 and an exhaust hose 156 coupled to opposing ends of the vacuum generator (see FIG. 5), one or both of the hoses may instead be coupled to an undersurface of the vacuum generator 150. In addition, the plenum chamber 153 and vacuum generator 150 may be formed as one piece. Such and other alterations, modifications, and improvements are intended to be part of this disclosure, and are intended to be within the scope of the invention. Accordingly, the foregoing description and drawings are by way of example only and is not intended to be limiting.

What is claimed is:

1. A vacuum plenum module of a stencil wiper assembly for wiping and removing excess material from a stencil of a stencil printer, the vacuum plenum module comprising:

a wiper blade to wipe the stencil;

a plenum chamber in direct fluid communication with the wiper blade, the plenum chamber having an opening formed therein; and a vacuum generator attached to and in direct fluid communication with the plenum chamber to create a vacuum within the plenum chamber, the vacuum generator having an opening proximate to the opening of the plenum chamber to provide the direct fluid communication between the vacuum generator and the plenum chamber.

2. The vacuum plenum module as claimed in claim 1, further comprising:

means for introducing pressurized fluid into the vacuum generator; and means for exhausting fluid from the vacuum generator.

3. The vacuum plenum module as claimed in claim 2, wherein the vacuum generator comprises at least one vacuum ejector adapted to create the vacuum.

4. The vacuum plenum module as claimed in claim 1, further comprising:

means for moving the vacuum plenum module between a first position in which the vacuum plenum is spaced away from the stencil and a second position in which the vacuum plenum engages the stencil.

5. A vacuum plenum module of a stencil wiper assembly for wiping and removing excess material from a stencil of a stencil printer, the vacuum plenum module comprising:

a vacuum plenum assembly having a blade portion for wiping the stencil and a plenum chamber in direct fluid communication with the blade portion and having an opening formed therein; and a vacuum generator attached to and in direct fluid communication with the plenum chamber of the vacuum plenum assembly, the vacuum generator being adapted to create a vacuum within the plenum chamber, the vacuum generator having an opening proximate to the opening of the plenum chamber to provide the direct fluid communication between the vacuum generator and the plenum chamber.

6. The vacuum plenum module as claimed in claim 5, wherein the vacuum generator comprises at least one vacuum ejector adapted to create the vacuum.

7. The vacuum plenum module as claimed in claim 6, further comprising an air supply hose in fluid communication between the vacuum generator and an air supply, and an exhaust hose in fluid communication between the vacuum generator and a collection chamber.

8. A stencil printer comprising:

a stencil;

a material applicator to apply material on the stencil; and a stencil wiper assembly to selectively wipe the stencil, the stencil wiper assembly comprising a vacuum plenum module including a vacuum plenum assembly having a wiper blade and a plenum chamber, in direct fluid communication with the wiper blade the plenum chamber having an opening formed therein, and a vacuum generator mounted on the plenum chamber of the vacuum plenum assembly and in direct fluid communication with the plenum chamber, the vacuum generator having an opening proximate to the opening of the plenum chamber to provide the direct fluid communication between the vacuum chamber and the plenum chamber.

9. The stencil printer as claimed in claim 8, wherein the vacuum generator comprises a chamber in fluid communication with the plenum chamber and at least one vacuum ejector disposed within the chamber.

10. The stencil printer as claimed in claim 9, further comprising an air supply in fluid communication between the vacuum generator and an air supply, and an exhaust in fluid communication between the vacuum generator and a collection chamber.

11. The stencil printer as claimed in claim 8, further comprising a seal disposed with the opening of the plenum chamber and the chamber of the vacuum generator to create a seal between the plenum chamber and the chamber of the vacuum generator.

12. The stencil printer as claimed in claim 8, said stencil wiper assembly further comprising:

a supply roller to receive a roll of paper;

a take-up roller to receive used paper; and a drive to move paper across the stencil between the supply roller and the take-up roller;

wherein the vacuum plenum module is operable to selectively engage the stencil with the paper disposed between the wiper blade and the stencil.

13. A method of cleaning a stencil of a stencil printer comprising a stencil wiper assembly having a vacuum plenum, in direct fluid communication with a wiper blade of the wiper assembly the method comprising:

loading substrate into the stencil printer;

dispensing material onto the substrate through the stencil;

cleaning the stencil with the vacuum plenum of the stencil wiper assembly; and generating a vacuum directly at the vacuum plenum to create a vacuum within the vacuum plenum.

14. The method set forth in claim 13 further comprising delivering a pressurized fluid to the vacuum plenum, and manipulating the pressurized fluid to create the vacuum.

* * * * *